US007244342B2

(12) United States Patent
Wood

(10) Patent No.: US 7,244,342 B2
(45) Date of Patent: Jul. 17, 2007

(54) MEMBRANE ELECTRODE SYSTEM FOR ELECTRO COATING

(76) Inventor: Brian Wood, P.O. Box 269, Prospect, KY (US) 40059

( * ) Notice: Subject to any disclaimer, the term of this patent is extended or adjusted under 35 U.S.C. 154(b) by 259 days.

(21) Appl. No.: 10/878,863

(22) Filed: Jun. 28, 2004

(65) Prior Publication Data

US 2005/0284749 A1 Dec. 29, 2005

(51) Int. Cl.
*C25B 13/02* (2006.01)

(52) U.S. Cl. ..... 204/282; 204/626; 204/640

(58) Field of Classification Search ..... 204/282, 204/626, 622

See application file for complete search history.

(56) References Cited

U.S. PATENT DOCUMENTS

| | | | | |
|---|---|---|---|---|
| 3,620,955 | A | 11/1971 | Jones | |
| 3,945,900 | A | 3/1976 | Klinkowski | |
| 4,711,709 | A | 12/1987 | Inoue | |
| 5,049,253 | A * | 9/1991 | Izuo et al. | 204/630 |
| 2004/0231992 | A1 * | 11/2004 | Hess et al. | 204/622 |

* cited by examiner

*Primary Examiner*—Kishor Mayekar
(74) *Attorney, Agent, or Firm*—Camoriano and Associates; Theresa Fritz Camoriano; Guillermo Camoriano

(57) ABSTRACT

A membrane electrode cell is disclosed which has a membrane cartridge that can readily be removed from the cell without disassembling the framework of the cell. Also, a membrane electrode cell is disclosed which has a water flow arrangement that removes debris from the bottom of the cell.

11 Claims, 10 Drawing Sheets

MEMBRANE ELECTRODE SYSTEM FOR ELECTRO COATING

BACKGROUND

Electro coating is a process in which a metal substrate is submerged in a paint bath, and a direct current electric potential is used to cause paint to be deposited onto the metal substrate. The paint can be classified as cathodic or anodic, with cathodic being when the substrate being painted is the cathode and anodic being when the substrate is the anode. The other electrode, either the anode or cathode, is also submerged in the paint bath. The paint is water soluble but poorly ionized and therefore must have chemicals added to increase the ionization. In cathodic paint, the additives are weak acids, and in anodic paint they are weak bases. As the paint is deposited onto the substrate, the additives are freed from the paint and begin to build up in the paint bath. After a short time, the additives will prevent the further deposition of paint, because the pH will either increase (anodic paint) or decrease (cathodic paint) until paint is dissolved off of the metal substrate. To combat this problem, membrane electrode cells have been used for many years. One such cell is described in U.S. Pat. No. 4,711,709.

An electrode cell includes an ion exchange membrane, which is mounted to a structural component to form a water tight chamber within the paint bath. An electrode is installed inside the chamber, along with water and additives. Since the ion exchange membrane allows ions to pass through, and since the ions are drawn into the water tight chamber by the DC potential, the pH of the paint bath can be controlled by controlling the pH inside the water tight chamber.

While the ion exchange membrane allows ions and the electric potential to pass into the paint, it keeps the paint outside the water tight chamber and keeps the water inside. The water tight chamber is continually flushed with a solution of water and additives by means of an external piping system. The fluid that leaves the water tight chamber goes into a tank, where the pH is controlled by purging and adding fresh water. Then, water from the tank goes back into the water tight chamber in order to maintain the proper pH in the water tight chamber and in the paint bath.

These electrode cells generally come in four types: flat or box type, semicircular, curved or low profile, and round. They are available in many sizes of each type, both in length and in electrode width or diameter. All types have electrodes that can easily be removed without removing the cell from the bath. In the case of cathodic paint, which is most common, the electrode is an anode which wears over time and must be replaced on a regular basis. The length of time an anode will last depends on many factors, including pH in the cell, current load, the presence of contaminants in the cell such as bacteria, chlorides, or iron oxide from the anode itself. The membranes lose efficiency over time and must be replaced periodically as well. The same factors that affect the life of the electrode also affect the life of the membrane.

One problem that shortens the life of the electrode and the membrane is the presence of heavy particles of bacteria and iron oxide, which tend to build up in the cells. In the case of cathodic paint, these particles cause localized wear on the bottom of the anode and, with both cathodic and anodic paint, they cause deterioration of membrane efficiency.

In the prior art cells, the only way to replace the membranes is to remove the cell from the bath and disassemble it to replace the membrane or discard the cell entirely and replace it with an entirely new cell. Existing cells use a system in which the membrane is held in place by bolts, which pass through clamping bars or frames, through a plastic mesh, and through the membrane, a gasket, and fiber-reinforced plastic or plastic back. The process of disassembly and reassembly can take several hours, depending upon the skill of the workers and the type of cell. In large paint systems, such as automotive plants, this means hundreds of man hours per year.

SUMMARY OF THE INVENTION

In a preferred embodiment of the invention, the membrane is an insert that can be removed from the cell and replaced from the top, leaving existing mesh in place. This saves significant labor and cost associated with replacing the membranes.

Also, in a preferred embodiment, the piping to the cell is changed in order to help remove particles from the cell. In this embodiment, a drain tube is run to the bottom of the cell in order to drain particulates out of the bottom of the cell rather than relying on upward flow to lift particulate waste out of the cell. The drain tube has a vacuum breaker at the top to prevent accidentally draining the entire bath if the cell is damaged. The vacuum breaker can simply be closed when the cell is to be emptied.

DETAILED DESCRIPTION OF THE PREFERRED EMBODIMENTS

Figure 1A:
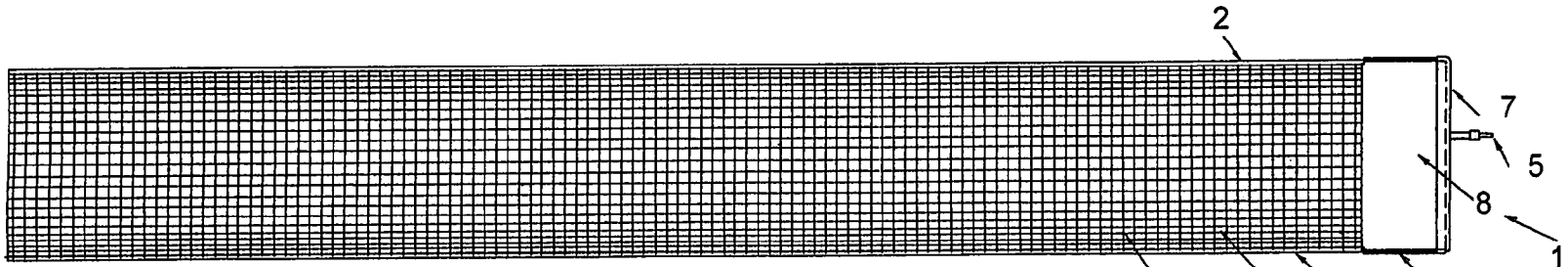
FIG. 1A is a front view of a semicircular cell made in accordance with the present invention.
Figure 1B:
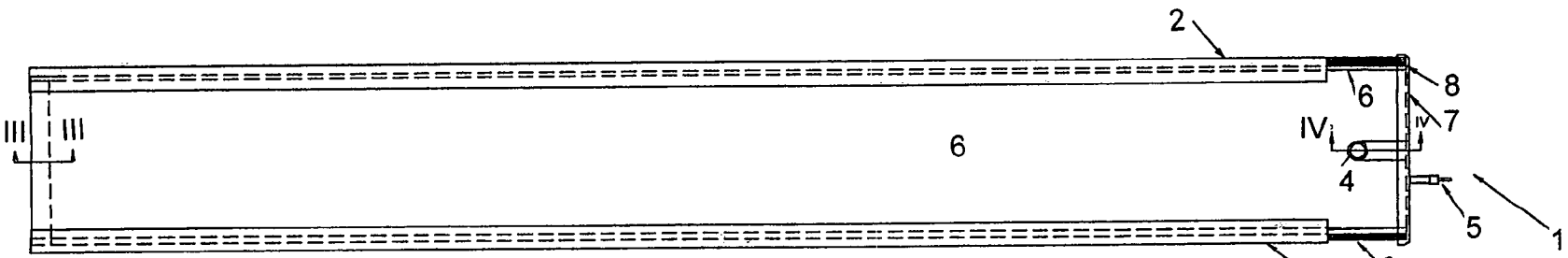
FIG. 1B is a rear view of the cell of FIG. 1A.
Figure 1C:
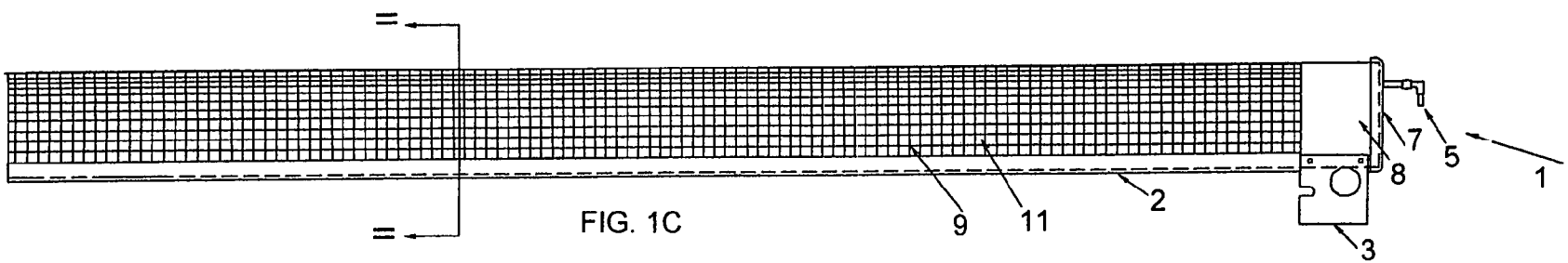
FIG. 1C is a side view of the cell of FIG. 1A.
Figure 2:
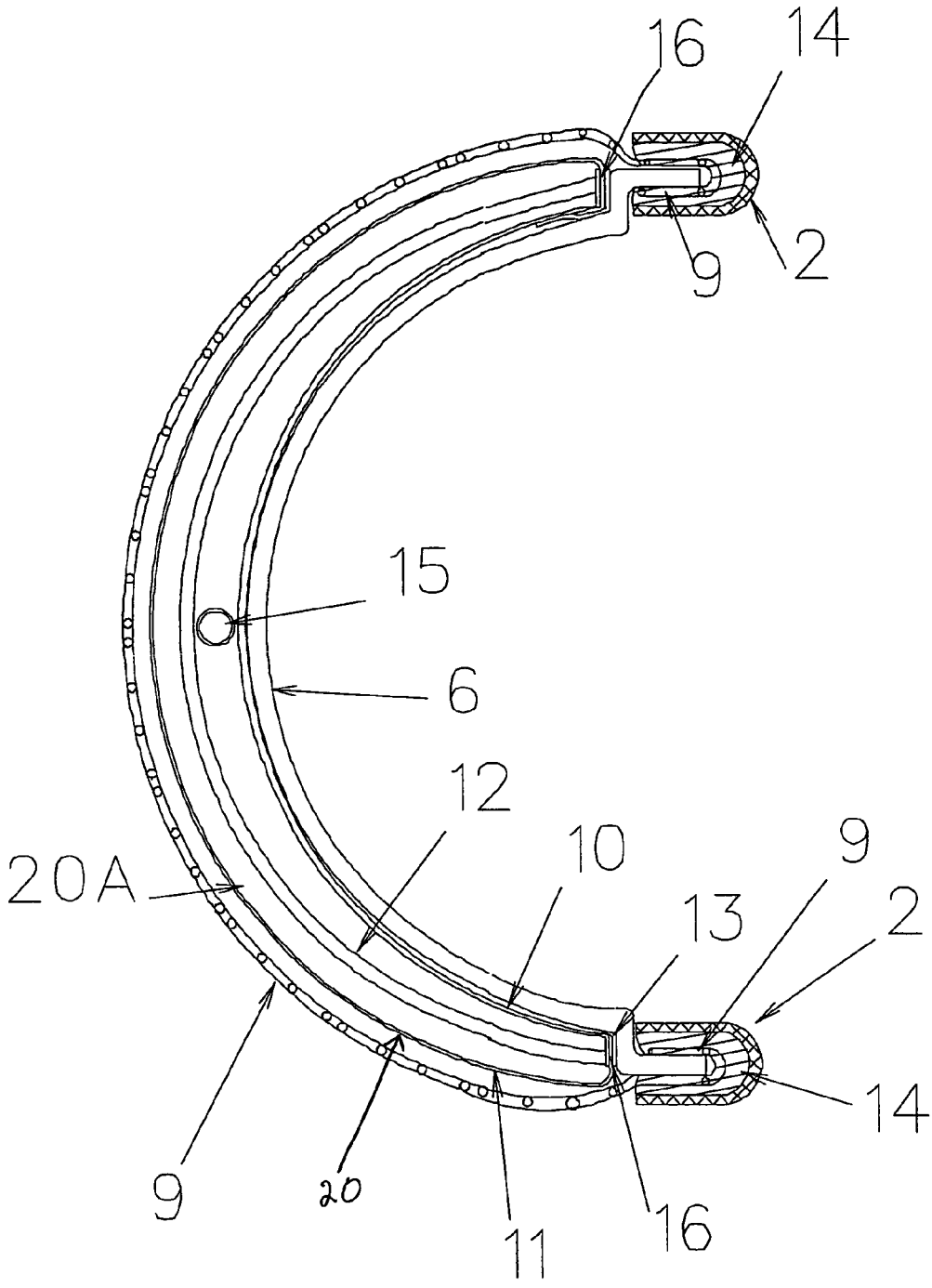
FIG. 2 is a view taken along the section II-II of FIG. 1C.

As shown in FIGS. 1A-1C and FIG. 2, the cell 1 includes a structural frame, including a back 6, left and right side channels 2, and a front mesh 9. As shown in FIG. 2, in a preferred embodiment, the mesh 9 is secured to the channels 2 by means of a potting compound 14, and the channels 2 fit over the edges of the back 6 and are held in place by friction. The back 6 preferably is made of fiber-reinforced plastic, but any nonconductive material capable of supporting the loads is acceptable. The back 6 serves as the main structural member and may be made by any number of manufacturing methods, from fiberglass reinforced plastic hand lay up to injection molded plastic, to coated steel. The mesh 9 can be made of any suitable nonconductive material, as long as it can support the water pressure inside the cell and does not conduct electricity. It should have as much open area as possible to prevent masking the electrode. The openings in the mesh preferably are several orders of magnitude larger than the openings in the membrane 11. For example, the openings in the mesh 9 may be on the order of one-half inch. As shown in FIG. 2, the mesh 9 wraps around the side edges of the back 6 and is held in place by the channels 2. While the potting compound 14 is preferred for holding the mesh 9 in place, it could instead be held in place by friction, by fasteners, or by other known means. The channel 2 may be made of a pipe with a slot cut into it, and it may be made of any nonconductive material, such as PVC.

As shown in FIG. 2, the back 6 and the front mesh 9 provide a structure or frame, within which the membrane cartridge 20 lies. The membrane cartridge 20 is in the shape of a pocket, having a height and width corresponding to the height and width of the cell 1, and the membrane cartridge 20 defines a water tight chamber 20A on its interior. The cartridge or pocket 20 is sealed along its sides 16 and bottom 10A and is open at the top. It is self-supporting and simply stands on the floor of the frame, which, in this case, is formed by the back 6. (See FIG. 4.)

The membrane cartridge 20 includes a membrane 11 and a back support 10, which are glued together along their side 16 and bottom edges to form a water-tight seal. The glued area is covered by a seal cover 13 on its inner surface. The seal covers 13 are glued to the membrane 11 and to the back support 10 to prevent moisture from getting to the glue joint. The seal cover may be just a strip made from a thin plastic sheet. The membrane 11 and back support 10 have essentially the same semi-circular cross-sectional shape and extend the length and width of the space formed between the mesh 9 and back 6, so the membrane cartridge 20 essentially fills that space.

The membrane 11 and back support 10 together serve as a wall that forms a watertight chamber.

In this preferred embodiment, the membrane 11 is made of a flexible, ion-permeable membrane material. The back support 10 can be made of PVC, fiber-reinforced plastic, rubber, or any number of materials. It need not carry any of the structural loads created by the water inside the cell as long as it conforms to the shape of the back 6 in order to transfer the loads to the back 6. While it may be made of flexible material, the membrane cartridge 20 has enough rigidity that it is self-supporting and can stand up within the frame on its own. In this preferred embodiment, the back support 10 is made of PVC, which is formed to fit the shape of the back 6. The back support 10 could be made of a flexible material that simply takes the shape of the back 6 when it is filled with water. Such materials as rubber or flexible PVC could be used, for example.

It is not necessary to have a separate back support 10. Instead, the membrane 11 could be made in a tubular shape and its bottom sealed in order to make the cartridge 20 entirely of the membrane material, if desired. However, since the membrane material is expensive, it is more likely that the front 11 of the pocket or cartridge 20 will be made of the membrane material while the back 10 of the pocket or cartridge 20 is made of a less expensive backing material that is sealed to the membrane 11 along its side and bottom edges.

The electrode element 12 is a solid metal anode, usually of stainless steel, but other metals and coated metals, such as a ruthenium oxide coated titanium may be used instead. The electrode element 12 also has a semi-circular cross-sectional shape, and it is inserted into the pocket 20 through the open top and extends essentially the full height and width of the pocket 20. An electrical connection (not shown) is provided at the top of the electrode element 12 to allow connection of the electrode element 12 to the DC power source. The electrode element 12 includes an enlarged top flange, which rests on top of the frame in order to suspend the electrode element 12 in the water tight chamber 20A.

The cell 1 includes piping, which permits water to be continuously removed and replaced. The piping may be the traditional piping (not shown), in which the water is inserted into the inside of the pocket 20 by means of a pipe which extends down from the top of the pocket 20 to the bottom of the pocket 20, and in which water leaves the pocket 20 by means of an overflow 4. Alternatively, the piping may provide an improved means for removing solids from the bottom of the pocket, as will be described later.

The top of the cell 1 has a loose fitting cap 7 to prevent paint spray from contaminating the cell 1. Non-conductive brackets 3 are attached to the back 6 by some known means such as bolts, to permit the cell 1 to hang on the top edge of the wall of a paint bath, and the electrode 12 is supported above the mesh with a plastic frame 8 that is also attached to the back 6.

Figure 4:
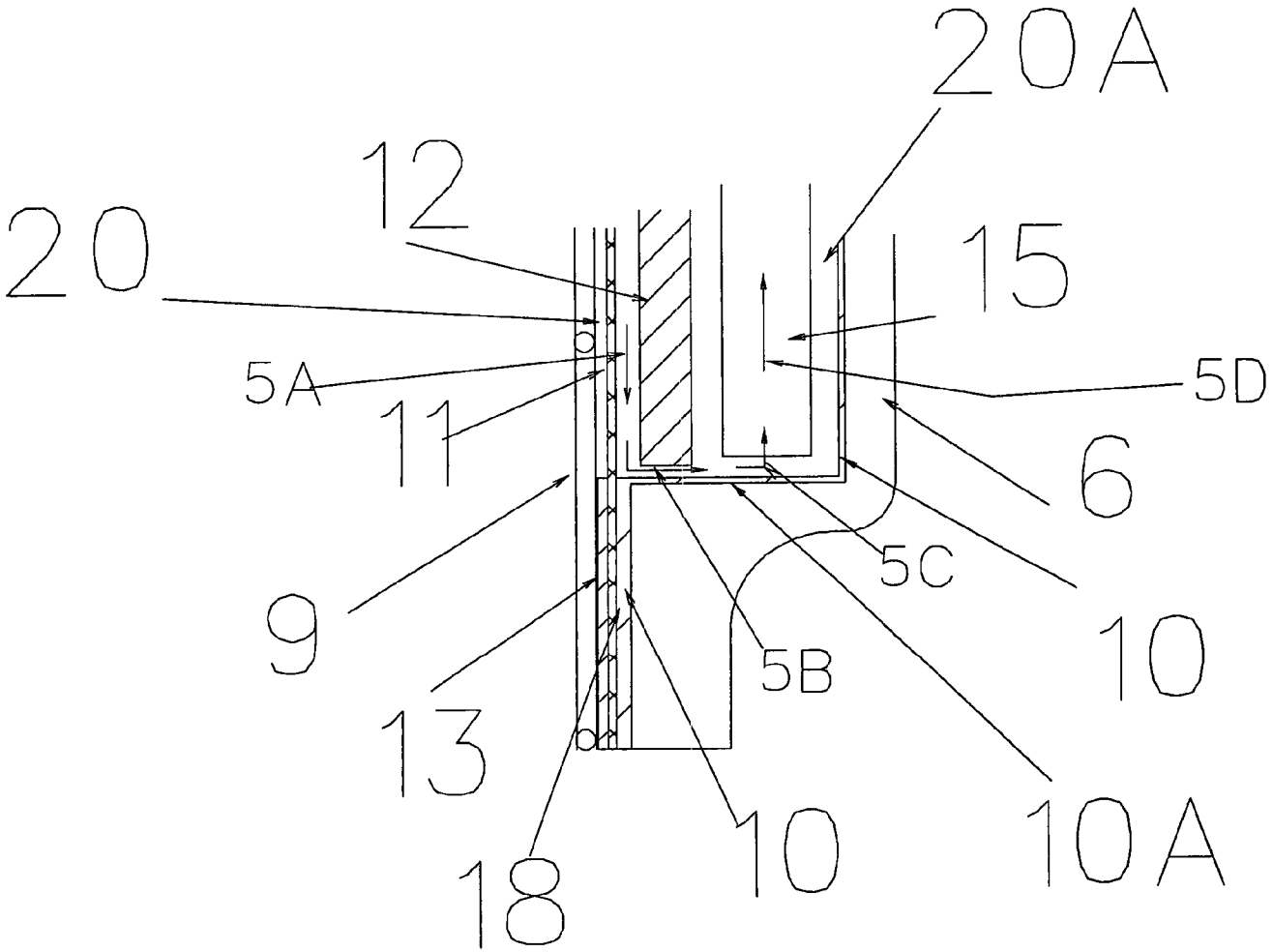
FIG. 4 is a view taken along line III-III of FIG. 1B, showing the bottom of the cell.
Figure 6:
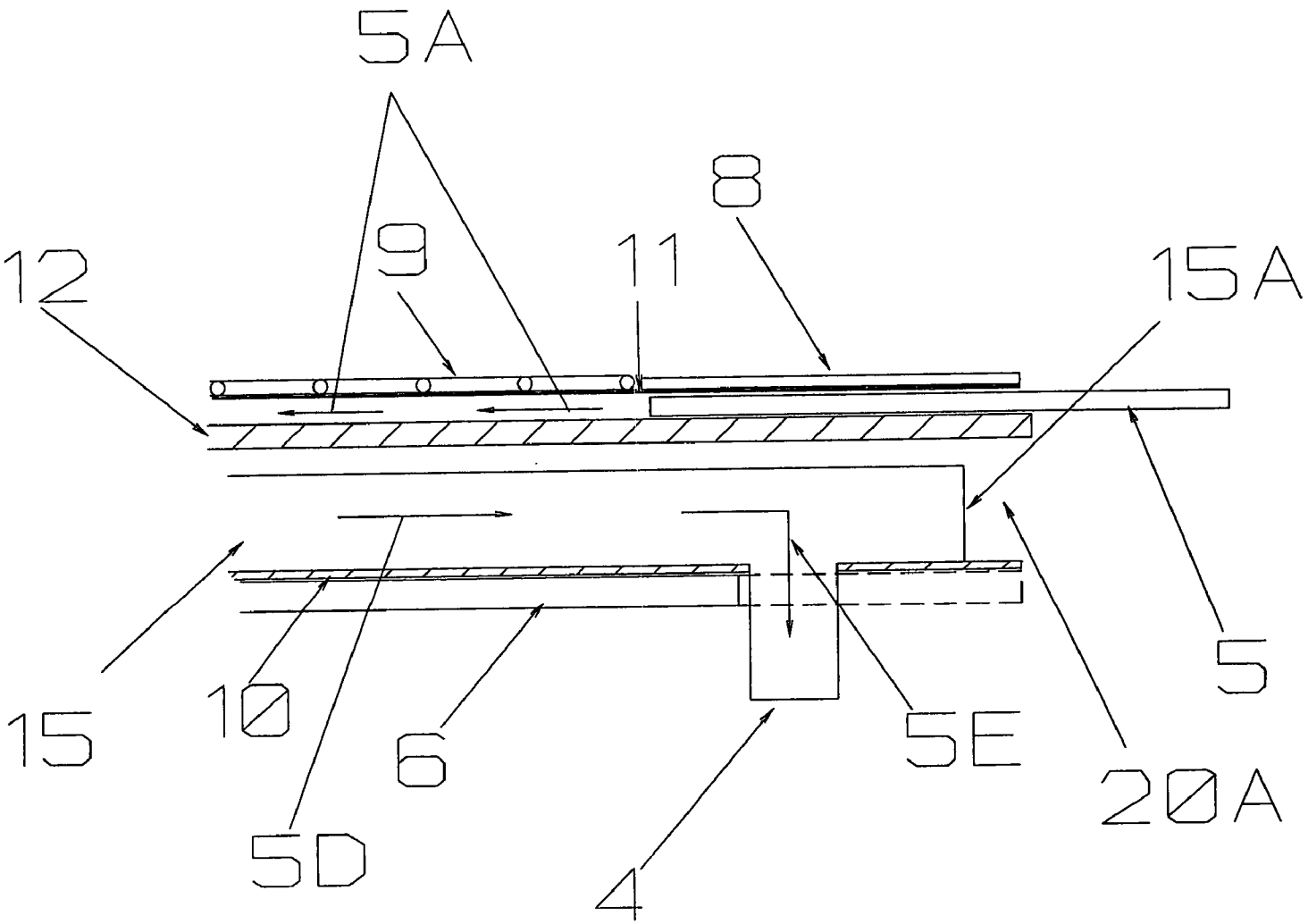
FIG. 6 is a view taken along the section IV-IV of FIG. 1B, showing the piping at the top of the cell.

FIGS. 6 and 4 show the top and bottom portions, respectively, of the piping arrangement for flowing water into and out of the water tight chamber 20A. The water is pumped from a tank (not shown) into the water tight chamber 20A through an inlet pipe 5, which is located between the electrode 12 and the membrane 11, and which extends only a few inches downwardly into the water tight chamber 20A. The inlet pipe 5 preferably does not extend downwardly more than one-fourth of the height of the water tight chamber 20A. The water then flows down the front of the electrode 12, along the space between the membrane 11 and the electrode 12, as indicated by the arrows 5A. The water then flows beneath the bottom of the electrode 12, as shown by the arrow 5B, and then upwardly into the bottom of an outlet pipe 15, as shown by the arrow 5C. The outlet pipe 15 extends to the bottom of the water tight chamber 20A, with just a small amount of clearance (preferably less than one inch) between the outlet pipe 15 and the bottom of the chamber 20A. The outlet pipe 15 extends upwardly to a point just below the top of the cell and is open at the top 15A to prevent siphoning. An overflow outlet 4 extends from the outlet pipe 15 and through the backing member 10 and the back 6 a few inches below the top of the outlet pipe 15. The water then flows up through the pipe 15, as indicated by the arrows 5D, and then out the overflow outlet 4, as indicated by the arrow 5E.

The space between the membrane cartridge wall (which is defined by the membrane 11 and the backing 10) and the electrode 12 has a much larger horizontal cross sectional area than does the outlet pipe 15, which means that the water flowing upwardly through the outlet pipe 15 has a much higher velocity than the water flowing downwardly through the space between the electrode 12 and the membrane 11.

As the water flows down through the space between the membrane 11 and the electrode 12 (arrows 5A), it takes heavy debris with it to the bottom. The debris then is drawn up the return pipe 15 and out the overflow 4 along with the water. The return pipe 15 should be of sufficient size to handle the water flow that is being pumped into the cell in order to prevent the cell from overflowing during operation. However, since the outlet pipe 15 has a much smaller cross-sectional area than the space between the electrode 12 and the the membrane 11, the water flow through the outlet pipe 15 has a much higher velocity than in traditional piping arrangements, thereby carrying more debris out of the cell than is the case in traditional piping arrangements.

The open top 15A of the return pipe 15 may be plugged when desired to allow a partial siphon for draining the cell or for cleaning out interior debris. The overflow pipe 4 is glued to the backing member 10 along its entire circumference to create a seal between the overflow pipe 4 and the backing member 10, so water cannot leak out of the water tight chamber 20A between the overflow pipe 4 and the backing member 10. Alternatively, a seal could be made using a gasket or by other know means, if desired. While this piping arrangement is preferred as a means for removing debris from the water tight chamber, a more traditional piping arrangement could be used instead.

In order to replace a membrane, the water is pumped out of the water tight chamber 20A, and the electrode 12 and membrane cartridge 20 are then lifted out the open top of the cell 1. A new membrane cartridge 20 is then inserted into the cell 1 through its open top until it stands on the bottom of the cell framework, and the electrode 12 is replaced so that it is suspended from the top of the cell 1. Then, water is pumped into the membrane cartridge 20, and the assembly is ready to be used again. This membrane replacement takes only a few minutes, as compared with approximately two hours for a typical membrane replacement in the prior art.

Figure 3:
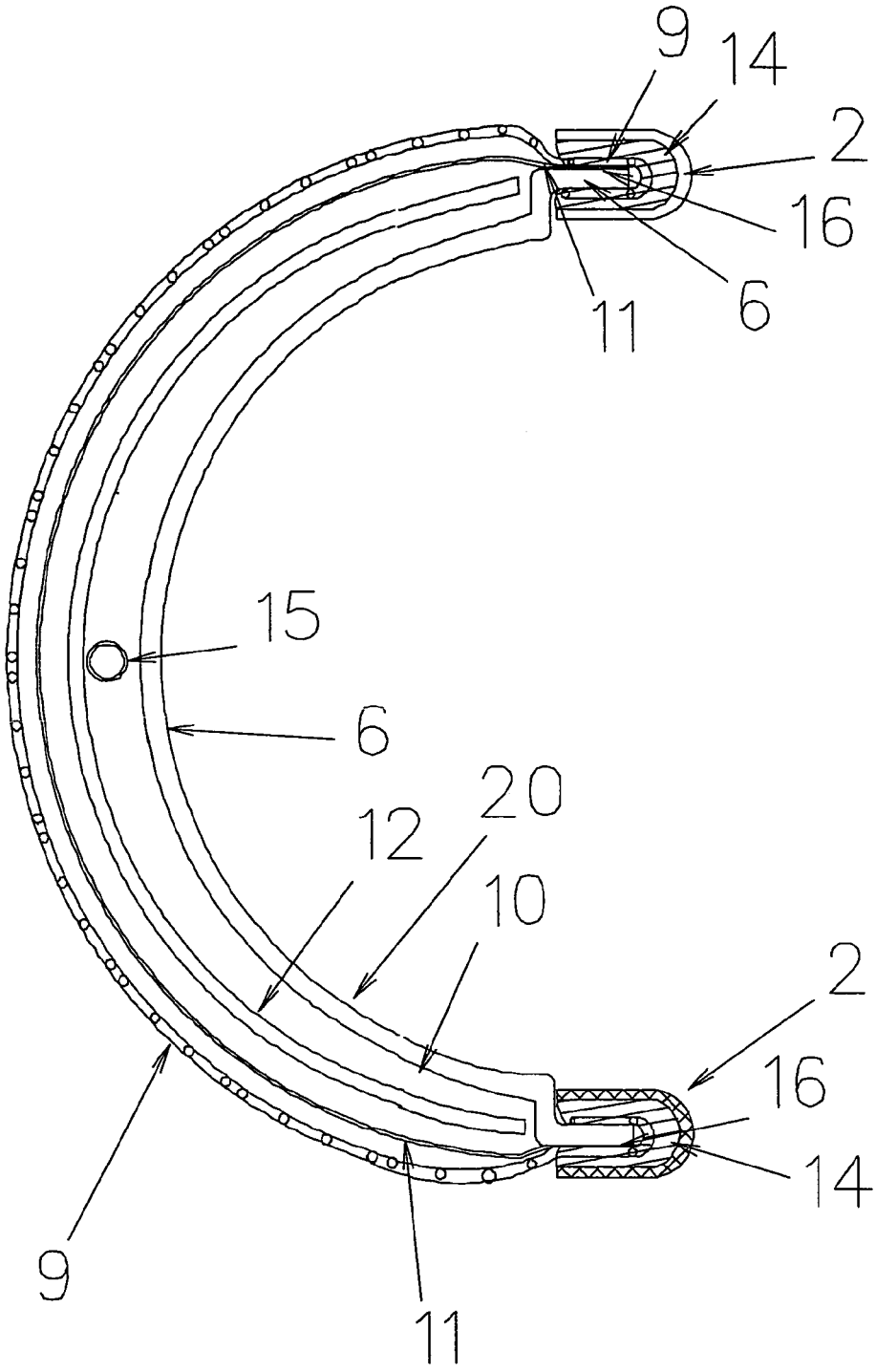
FIG. 3 is a view similar to the view of FIG. 2, but showing an alternative embodiment, in which the membrane is glued directly to the back.
Figure 5:
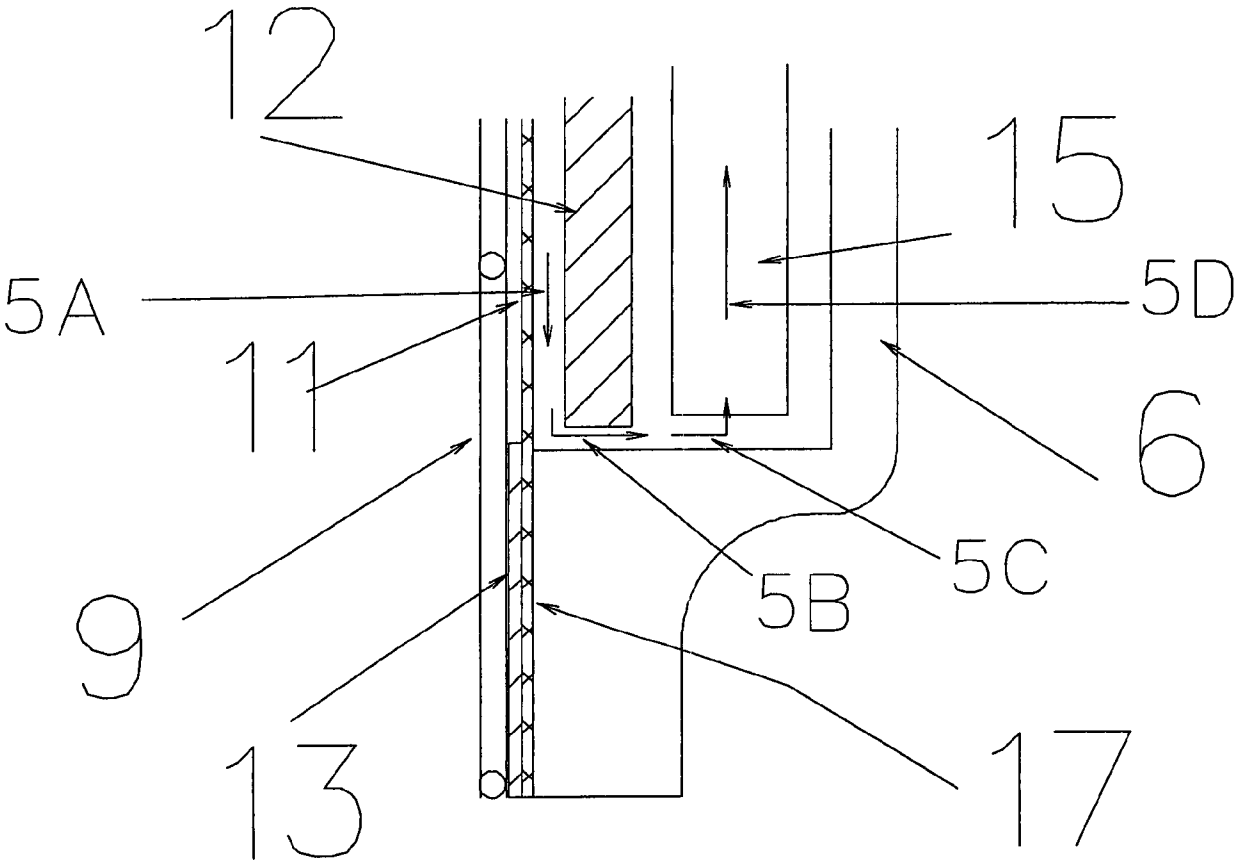
FIG. 5 is the same view as FIG. 4, but for the embodiment of FIG. 3, in which the membrane is glued directly to the back.
Figure 7:
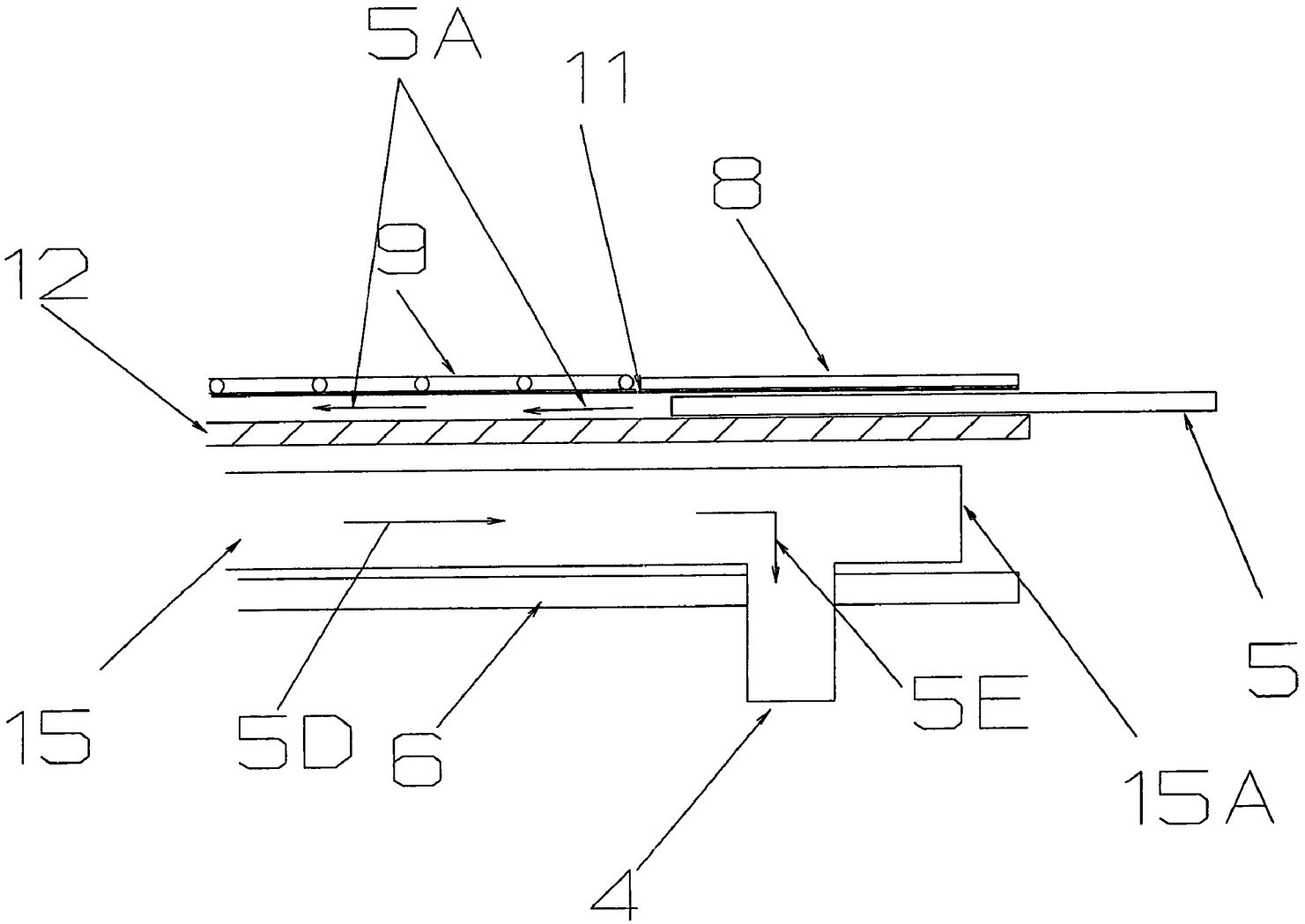
FIG. 7 is the same view as FIG. 6 but for the embodiment of FIG. 3.

An alternative embodiment is shown in FIGS. 3, 5, and 7. This embodiment is the same as the first embodiment, except that, instead of using a back support 10, the membrane 11 is glued directly to the side edges 16 and bottom edge 17 of the back 6. So, in this case, the pocket or cartridge 20' which holds the water is formed by the membrane 11 and the back 6. In this case, to replace the membrane 11, the electrode is removed, water is pumped out of the cartridge 20', and the cell is removed from the tank. Then, the cartridge 20' is removed from the channels 2, leaving the framework of the channels 2 and mesh 9. A new cartridge 20' is then inserted into the channels 2. The refurbished cell is then returned to the tank, an electrode is inserted, and water is replaced inside the cartridge 20'.

Figure 8:
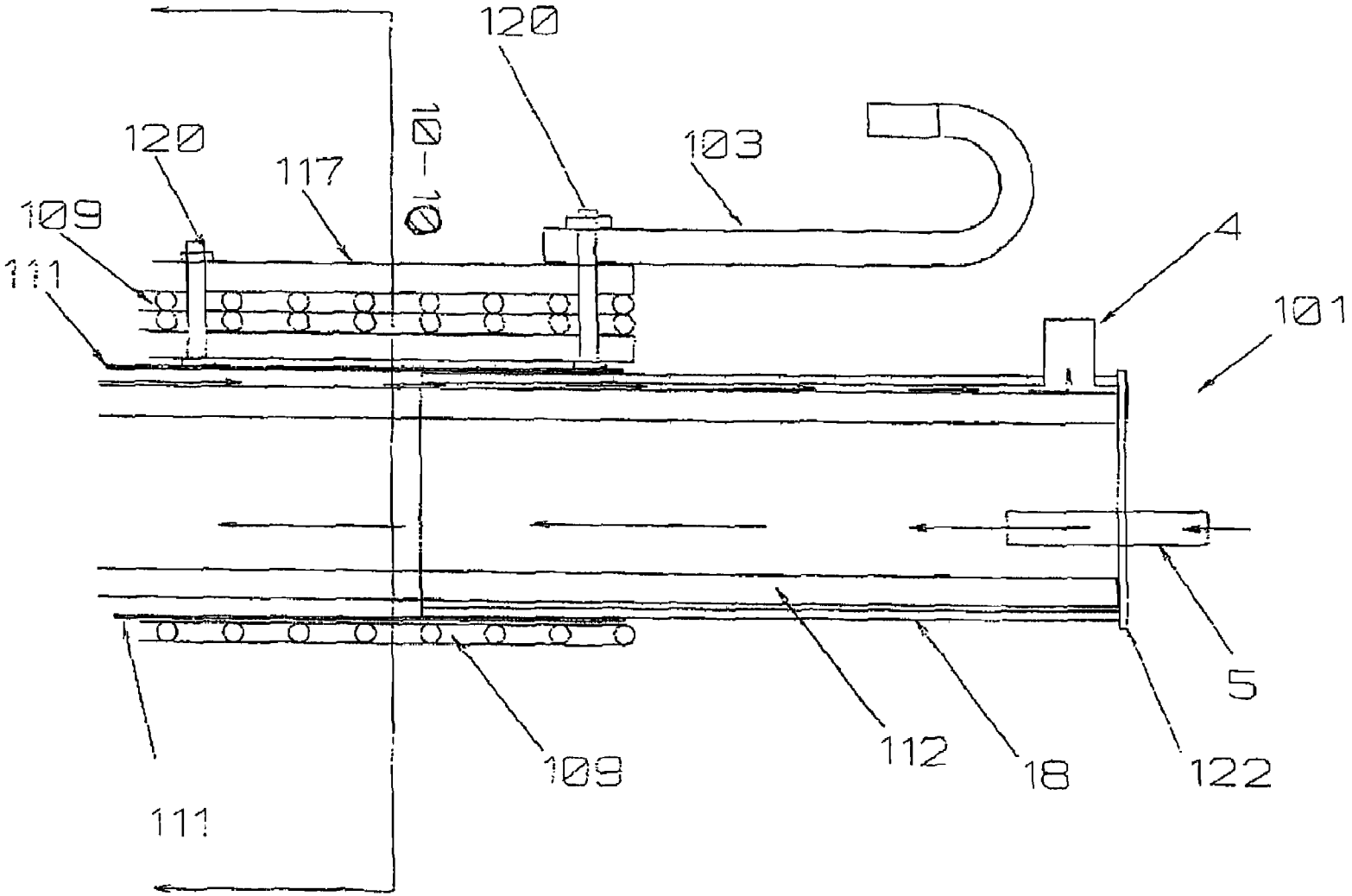
FIG. 8 is a sectional view showing the top portion of a round cell made in accordance with the present invention.
Figure 9:
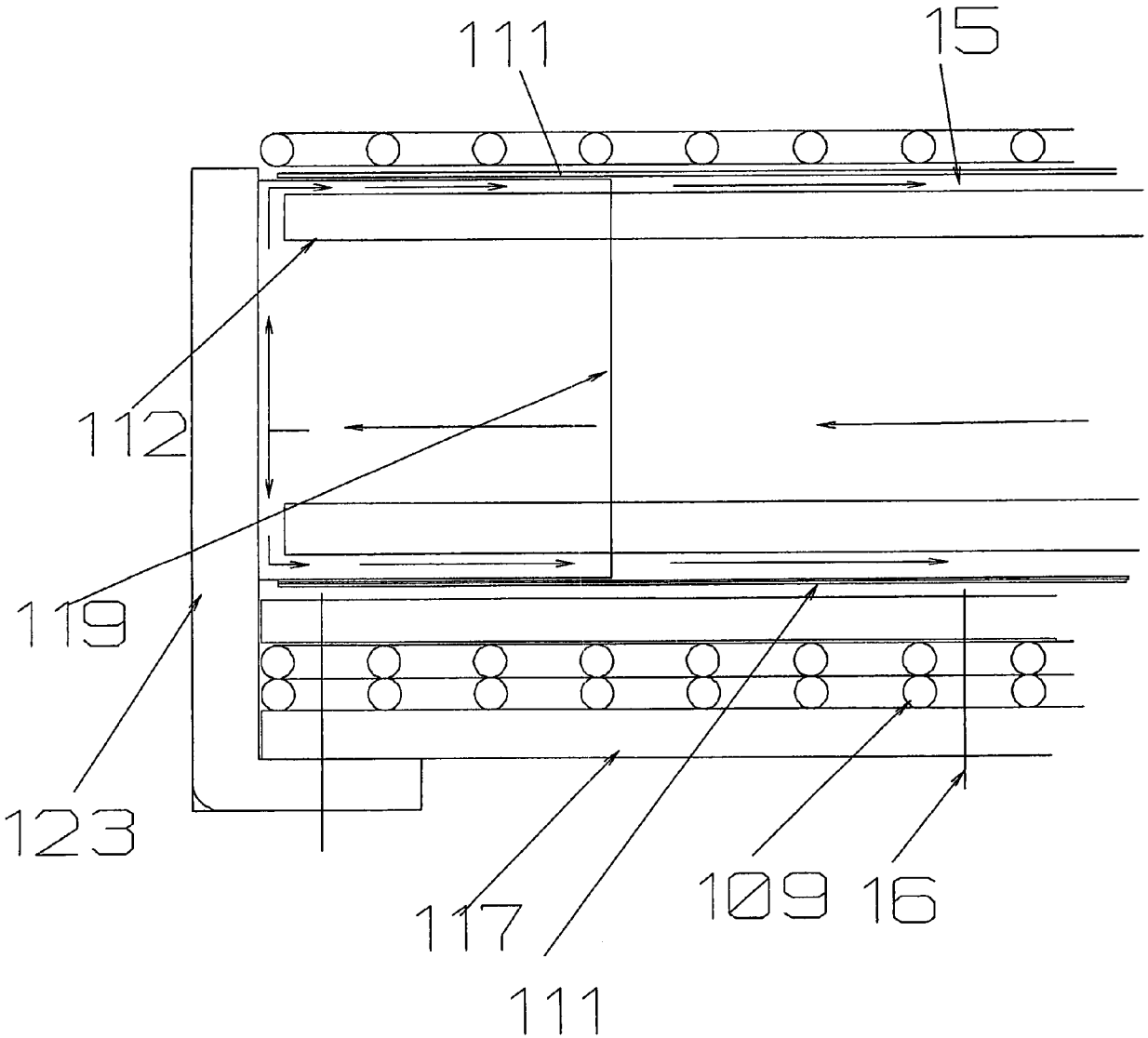
FIG. 9 is a sectional view showing the bottom portion of the cell of FIG. 8.
Figure 10:
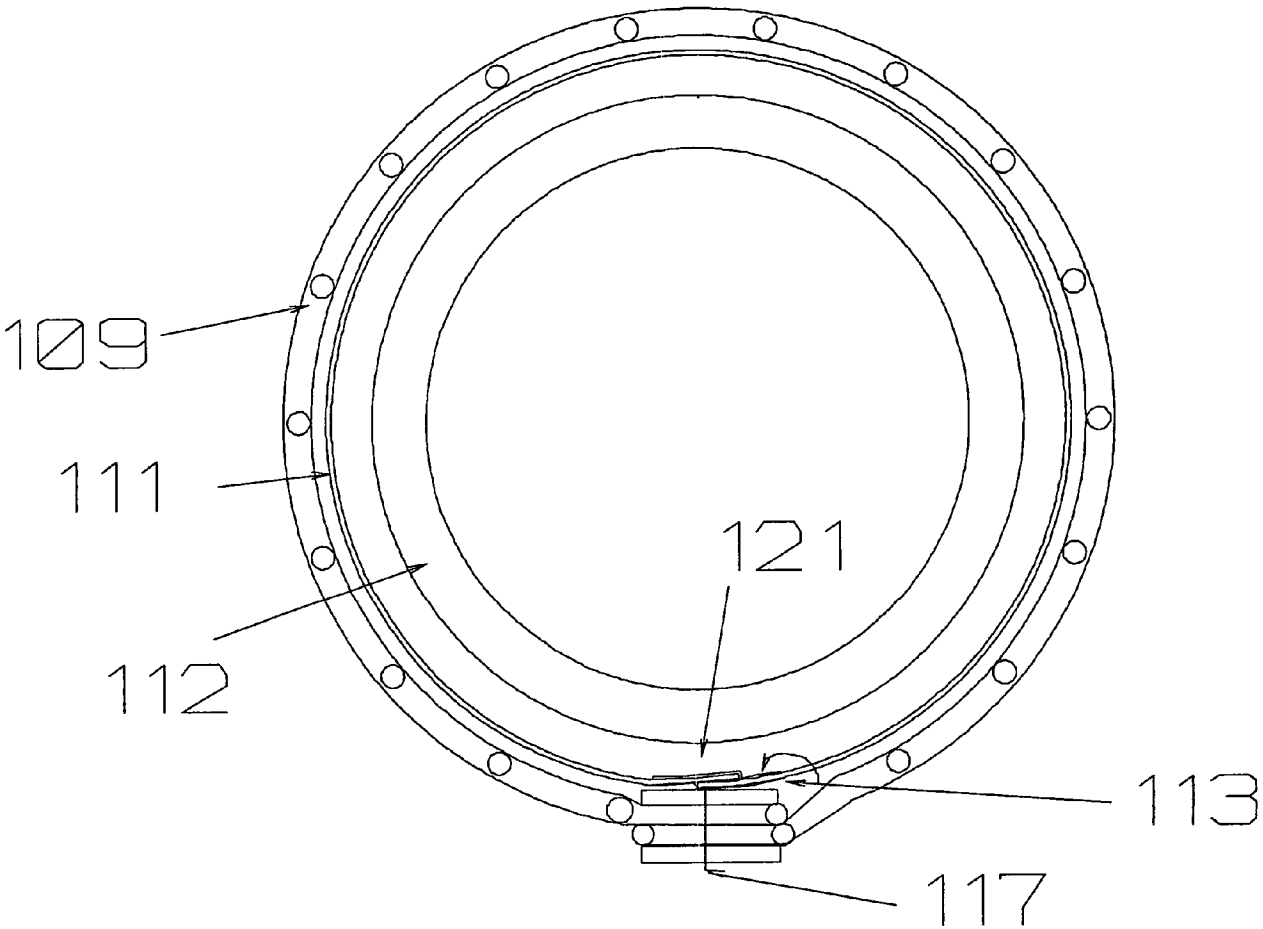
FIG. 10 is a view taken along the section 10-10 of FIG. 8.

Another alternative embodiment is shown in FIGS. 8-10. This embodiment uses a circular cross-section cell 101, including a tubular electrode 112, a tubular membrane 111, a bottom cap 119, an upper pipe 18 with an overflow outlet 4, a mesh 109 encircling the membrane 111, and a support bracket 103, which supports the cell 101 on the side of the tank.

The electrode 112 preferably is a pipe made of stainless steel. It hangs from the top of the cell 101 by means of a plate 122 that is welded to the electrode 112. The plate 122 has a central hole, which receives the inlet pipe 5. It also has a hole (not shown) for connecting the electrode 112 to DC power. The electrode 112 can be removed simply by lifting it vertically upwardly out of the cell 101.

The membrane 111 has a tubular shape, which preferably is formed by taking a rectangular piece of membrane material and overlapping its edges to form a glued joint 121 running the full length of the tube. The glued joint 121 is covered with sealing strips 113 on its inner and outer surfaces to keep the joint dry.

The bottom cap 119 has a generally cylindrical shape with a closed bottom. The cap 119 fits inside the membrane 111 and is glued to the membrane 11 to form a bottom seal. The upper pipe 18 has a cylindrical shape, with open top and bottom. The upper pipe 18 fits inside the top of the membrane 111 and is glued to the membrane 111. The membrane 111, with its bottom cap 119 and upper pipe 18, is free-standing, resting on the bottom bracket 123.

The mesh 109 is also formed into a cylindrical shape with its edges overlapped and clamped together by clamping bars 117, which are held together by bolts 120 or other fasteners. Some of the bolts 120 also extend through the bracket 103, which hooks over the side of the tank (not shown). The bracket 103 may also be bolted to the tank to avoid swaying, as the bracket can remain with the tank unless it is damaged. The clamping bars 117 extend to the bottom of the cell 101, where they are secured to the L-shaped bracket 123, which forms the bottom of the mesh frame.

The membrane 111 can be removed from the cell 101 by lifting the electrode 112 out of the cell 101 and then lifting the membrane 111 out of the cell.

The flow of water in the cell 101 is shown as the more traditional flow, with the water entering the cell 101 through the inlet pipe 5, which terminates a few inches below the top of the cell 101. The water then flows down inside the electrode 112, around the bottom of the electrode, and then upwardly between the electrode 112 and the membrane 111, overflowing out the overflow pipe 4, which is sealed around its circumference to the upper pipe 18, in order to prevent leaking.

It will be obvious to those skilled in the art that modifications may be made to the embodiments described above without departing from the scope of the present invention.

What is claimed is:

1. A membrane electrode cell, comprising:

a frame, including a bracket for supporting the cell and securing it to a tank;

an ion exchange membrane cartridge mounted inside the frame including a wall that forms a watertight chamber having a top and a bottom;

an electrode mounted in said watertight chamber;

an inlet tube extending a short distance from said top into a space defined between said electrode and said wall;

an outlet tube extending from the bottom of said watertight chamber to a point near the top; and means for removing the membrane cartridge from the frame without disassembling the frame.

2. A membrane electrode cell as recited in claim 1, wherein said frame includes a mesh front and a bottom and defines a top opening;

said membrane cartridge is free-standing on said bottom of said frame; and said means for removing the membrane cartridge includes lifting it out of the frame through the top opening.

3. A membrane electrode cell as recited in claim 2, wherein said electrode has a semi-circular cross-section.

4. A membrane electrode cell as recited in claim 2, wherein said electrode has a circular cross-section.

5. A membrane electrode cell as recited in claim 1, wherein said wall includes a membrane and a backing member, wherein said backing member is adhered to said membrane to form said watertight chamber.

6. A membrane electrode cell as recited in claim 5, wherein said frame includes side members defining elongated grooves which receive said backing member.

7. A membrane electrode cell as recited in claim 5, wherein said frame includes a back, and said backing member conforms to the shape of said back.

8. A membrane electrode cell as recited in claim 1, wherein said space between said electrode and said wall defines a horizontal cross-sectional area, and said outlet tube defines a horizontal cross-sectional area, and wherein said horizontal cross-sectional area of said outlet tube is substantially smaller than said horizontal cross-sectional area of said space between said electrode and said wall.

9. A membrane electrode cell, comprising:

a frame, including a mesh and a bracket for supporting the cell and securing it to a tank;

a membrane cartridge mounted inside the frame including a wall which forms a watertight chamber, having a closed bottom and an open top;

an electrode mounted in said watertight chamber, wherein a space is defined between said electrode and said wall;

an inlet tube extending through said open top into said space; and an outlet tube extending from the bottom of said membrane cartridge to a point near said open top.

10. A membrane electrode cell as recited in claim 9, wherein said inlet tube extends downwardly into said chamber a short distance that is less than one-fourth the height of said chamber.

11. A membrane electrode cell as recited in claim 9, wherein the horizontal cross sectional area between said electrode and said wall is substantially greater than the horizontal cross sectional area of said outlet tube.

* * * * *